US008448366B2

(12) United States Patent
Faifer

(10) Patent No.: US 8,448,366 B2
(45) Date of Patent: May 28, 2013

(54) PISTOL CONVERTER

(76) Inventor: Sagi Faifer, Mishmar Hashiva (IL)

( * ) Notice: Subject to any disclaimer, the term of this patent is extended or adjusted under 35 U.S.C. 154(b) by 80 days.

(21) Appl. No.: 12/896,977

(22) Filed: Oct. 4, 2010

(65) Prior Publication Data

US 2011/0107644 A1 May 12, 2011

Related U.S. Application Data

(60) Provisional application No. 61/248,464, filed on Oct. 4, 2009.

(51) Int. Cl.
*F41C 23/00* (2006.01)

(52) U.S. Cl.
USPC ..... 42/71.02; 42/72; 42/71.01

(58) Field of Classification Search
USPC ..... 42/71.02, 72, 75.03, 71.01
See application file for complete search history.

(56) References Cited

U.S. PATENT DOCUMENTS

| | | | | |
|---|---|---|---|---|
| 1,877,016 | A * | 9/1932 | Munson | 42/72 |
| 2,139,691 | A * | 12/1938 | Michal, Jr. | 89/140 |
| 3,369,316 | A * | 2/1968 | Miller | 42/72 |
| 3,685,194 | A * | 8/1972 | Coon | 42/77 |
| 4,271,623 | A * | 6/1981 | Beretta | 42/72 |
| 4,735,007 | A * | 4/1988 | Gal | 42/72 |
| 6,318,014 | B1 * | 11/2001 | Porter | 42/72 |
| 2009/0282718 | A1 * | 11/2009 | Bartley | 42/75.03 |

* cited by examiner

*Primary Examiner* — Daniel J Troy
(74) *Attorney, Agent, or Firm* — Deborah Gador

(57) ABSTRACT

A pistol converter including a body defining a forward pistol barrel engaging portion, a stock coupled to the body, and a rear engagement member for firmly engaging an external portion of a rear of a frame of the pistol.

13 Claims, 12 Drawing Sheets

PISTOL CONVERTER

FIELD OF THE INVENTION

The present invention relates to pistols, in general and, in particular, to a conversion kit for converting a pistol to a short-barreled rifle or a submachine gun-like weapon.

BACKGROUND OF THE INVENTION

Rifles are inherently more accurate than handguns. Attempts have been made to increase the accuracy of handguns by attaching stocks having telescopic sights to pistols. One such stock, a GLR 440 by Fobus includes a spring-release connecting rod that attaches to the grip of a variety of handguns manufactured by Glock Ges.m.b.H., Deutsch-Wagram, Austria.

A pistol tactical platform (P.T.P. V.01 for Glock 19/23) is marketed by Action items Ltd., Tel Aviv, Israel, which provides an ergonomic 5 point weapon grip designed only for a Glock pistol. This platform includes a mounting rail to enable mounting of optics, sights and accessories. However, this platform is relatively large and awkward in shape due to the arm engaging the pistol grip.

There is also known a Glock carbine conversion kit (G.C.C.) manufactured and marketed by H.E.R.A., Germany. This conversion kit is mounted on the available front Picatinny rail of the pistol and utilizes a front rail locking bolt. The G.C.C. allows the possibility to mount a front fore-grip, lamps, lasers and iron sights to the additional Picatinny rails. However, this converter is very high, since it includes a curved guide element for guiding spent cartridges to the side of the firearm and away from the shooter. Furthermore, the rear of the pistol is not engaged by the converter, so the pistol is not completely stable.

There is thus a widely recognized need for a universal pistol converter, suitable for holding a pistol of any type, and it would be highly advantageous to have such a kit which is streamlined and compact yet permits mounting of desired accessories on the pistol.

SUMMARY OF THE INVENTION

The present invention relates to a pistol converter providing stability and ease of handling in a compact design. The pistol converter includes a rear engagement member for firmly engaging the hand protecting protrusion on the rear of the pistol frame, as well as a barrel-engaging portion, thereby providing stability to the pistol in the converter. Preferably, either or both of the engagement member and the engagement portion is spring loaded for ease of insertion of a pistol with firm engagement of the pistol in the converter.

According to the present invention there is provided a pistol converter for a pistol including a frame, the converter including a body defining a pistol barrel engaging portion, a stock coupled to the body, and a rear engagement member for firmly engaging an external portion of a rear of the frame of a pistol mounted in said body.

According to a preferred embodiment, at least one of said barrel engaging portion and said rear engagement member is spring loaded in said body for firm engagement of a pistol in the converter.

According to another embodiment of the invention, the body includes an ejection aperture defined above and in registration with an ejection port of the pistol.

Preferably, the body includes a cut-away rear opening through which sights on the pistol can be used.

There is also provided, according to the invention, a method for forming a pistol converter for holding a pistol having a frame, the method including forming a body defining a forward pistol barrel engaging portion, coupling a stock to the body, and mounting a rear engagement member in the body for firmly engaging an external portion of a rear of the frame of the pistol.

According to one embodiment of the invention, the step of coupling includes coupling by means of a hinge permitting folding adjacent the body According to another embodiment of the invention, the step of mounting includes mounting a spring loaded rear engagement member for engaging the external portion of the frame, most particularly the hand-protection protrusion.

BRIEF DESCRIPTION OF THE DRAWINGS

Exemplary apparatus constructed and used in accordance with the teachings of the present invention is described and explained in greater detail below with the aid of drawings figures in which.

DESCRIPTION OF THE PREFERRED EMBODIMENTS

The present invention relates to a pistol converter that can be used to convert a pistol to a short-barrel rifle or a submachine gun-like weapon. The pistol converter is a compact converter that can be held at five points by a shooter: by two hands (at the front and the rear, e.g., on the pistol grip), shoulder, cheek and hand or arm—that firmly grips the pistol without permitting movement of the pistol in the converter.

Figure 1:
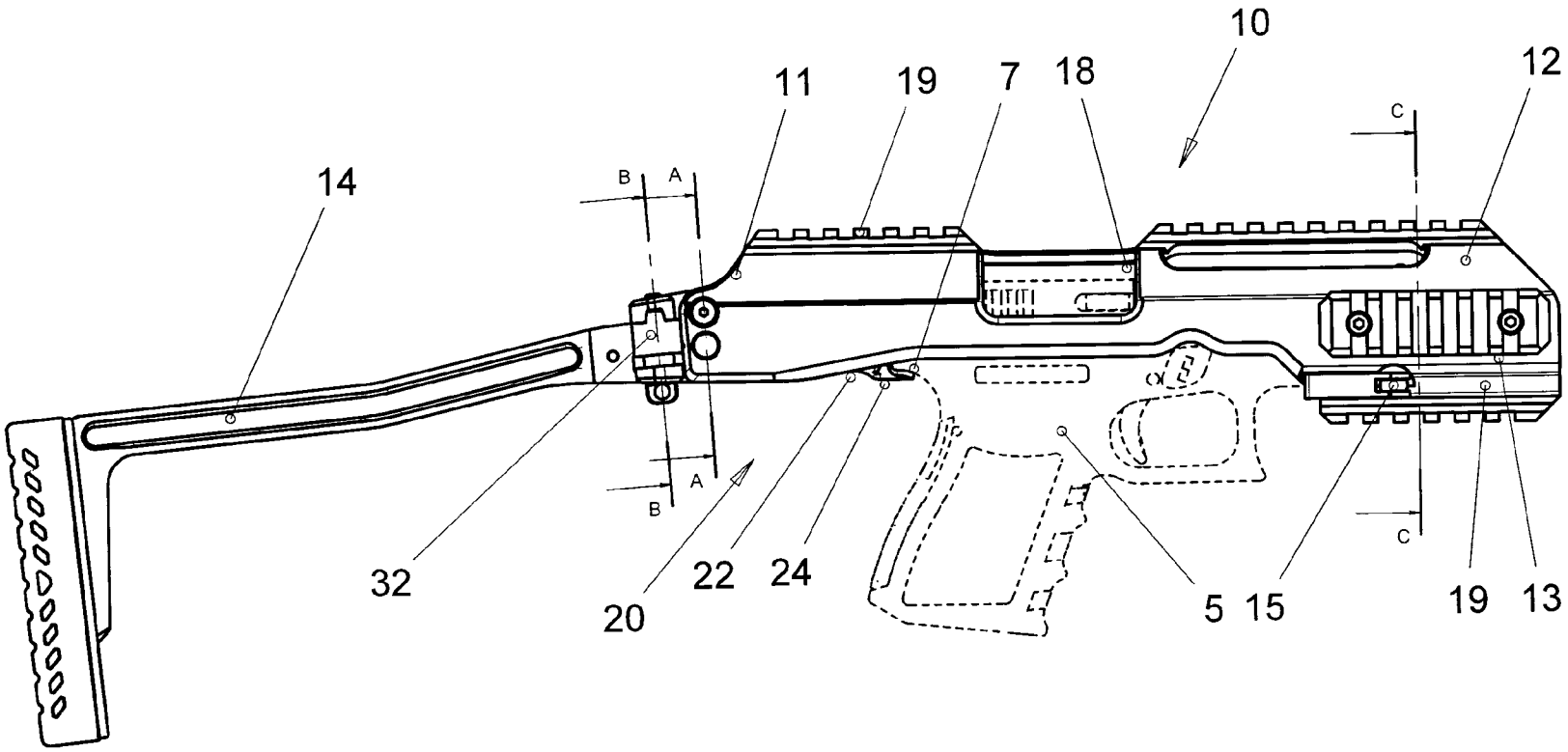
FIG. 1 is a side view of a pistol converter, constructed and operative in accordance with one embodiment of the present invention.

Referring now to FIG. 1, there is shown a side view of a pistol converter 10, constructed and operative in accordance with one embodiment of the invention, with a pistol 5 mounted therein. Pistol converter 10 includes a body 12, having a pistol-engaging assembly 20 for holding a pistol, and a stock 14 coupled to body 12. Assembly 20 includes a barrel engaging portion 13 in the front of the converter, for cradling the barrel of a pistol. Preferably, a locking pin 15 is provided to lock the barrel inside barrel engaging portion 13, as by passing through a lower Picatinny rail on the pistol.

An ejection aperture 18 is defined above the location of the ejection port of a pistol when held in the converter. Ejection aperture 18 is cut out of body 12, so it does not interfere with ejection of spent cartridges from the pistol during use. If desired, one or more mounting rails 19 may be provided on converter 10 for the addition of accessories. Preferably, mounting rails having longitudinally spaced ribs are utilized, typically Picatinny rails.

It is a particular feature of the invention that the converter of the present invention can be utilized to hold substantially any pistol, as it does not require any special structure on the pistol, itself. As can be seen, pistol-engaging assembly 20 includes a rear engagement member 22 for firmly engaging an external portion of the rear of a pistol frame, thereby fastening pistol 5 to the converter. Unlike conventional Glock converters, which engage an internal bore in the Glock handle only, the rear engagement member 22 of the converter of the present invention is shaped to engage an external portion of the rear of any pistol, thereby making the converter substantially universal. In this embodiment, rear engagement member 22 defines a groove 24 for engaging a hand protecting protrusion 7 on the rear of the frame of pistol 5.

Preferably, either or both of the barrel engagement portion 13, or rear engagement member 22 include a spring mechanism for snugly engaging pistol 5, thereby providing stability to the pistol, regardless of the manufacturer. In the illustrated embodiment, rear engagement member 22 is provided with a spring mechanism 25, described in detail below.

Figure 2A:
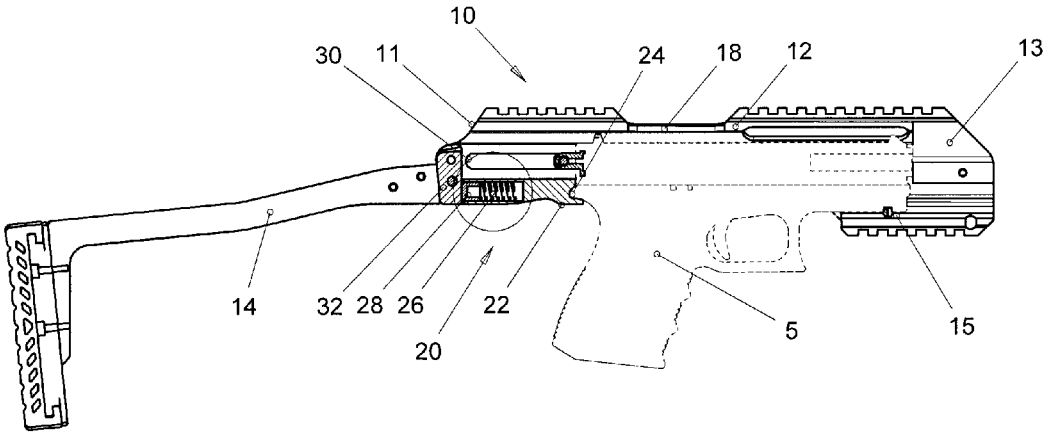
FIG. 2*a* is a side sectional view of the pistol converter of FIG. 1.
Figure 2B:
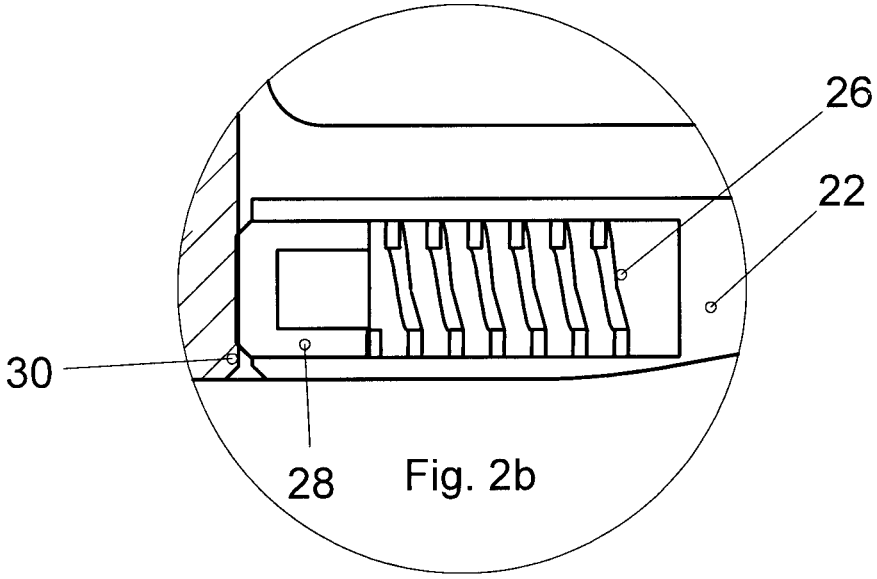
FIG. 2*b* is an enlarged detail view of a spring mechanism.

FIGS. 2*a* and 2*b* are side sectional and enlarged detail views, respectively, of a pistol converter 10 showing a pistol-engaging assembly 20 according to one embodiment of the present invention. According to this embodiment, rear engagement member 22 is spring loaded in a track in the converter body and held in place by a spring mechanism 25. Spring mechanism 25 includes a spring 26, supported on closure plate 30. Spring 26 urges rear engagement member 22 and pistol 5 held therein, forwards towards barrel engaging portion 13. As shown in FIG. 2*b*, spring mechanism 25 includes a pressing member 28 disposed in a bore inside rear engagement member 22, supported on closure plate 30.

According to some embodiments of the invention, closure plate 30 can be removed from converter 10 in order to permit insertion and removal of a pistol 5 from converter 10. Removing closure plate 30 releases rear engagement member 22, and spring mechanism 25, all of which can be removed and replaced.

Figure 3:
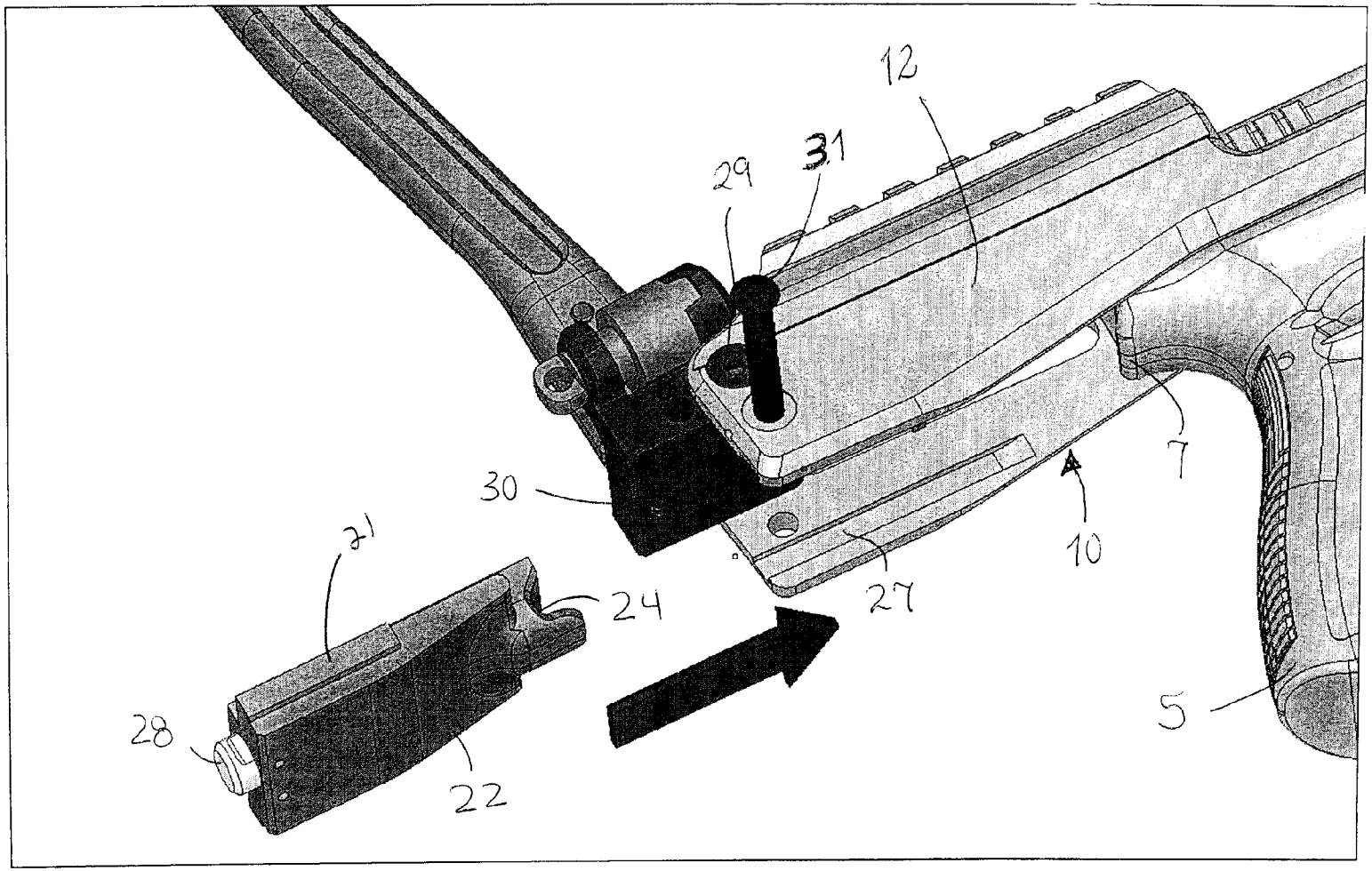
FIG. 3 is a perspective view of the pistol converter of FIG. 1 in an open orientation.

According to one embodiment of the invention, illustrated in FIG. 3, closure plate 30 is pivotally mounted on body 12 of converter 10 by means of a hinge 29. Once the barrel of a pistol 5 has been inserted into the barrel engaging portion of the converter, the stock and closure plate 30 are pivoted upwards about hinge 29. Rear engagement member 22 is inserted into mounting grooves 27 in the converter body and pushed forward in the direction of the arrow, as by means of complementary rails 21 defined on rear engagement member 22, until the groove 24 therein engages a portion of the rear of the pistol, here shown as the hand protecting protrusion 7 on the rear of the frame of pistol 5. Closure plate 30 is now pivoted back to the closed position, wherein it engages pressing member 28. Closure plate 30 may be fastened in this closed orientation by means of a locking pin 31 inserted through the side of body 12.

Figure 4A:
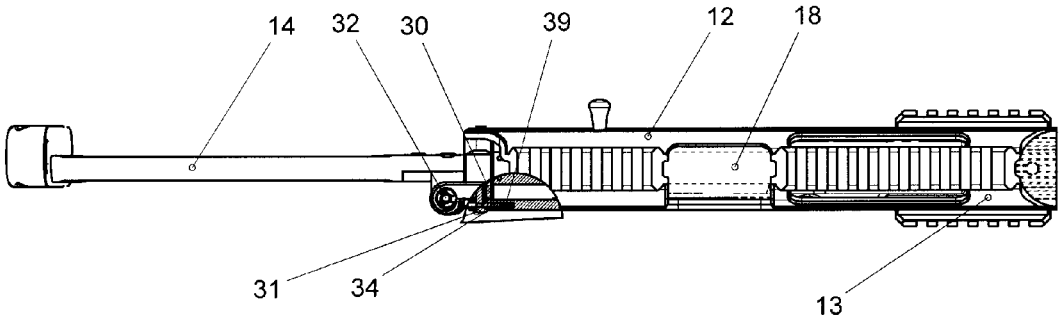
FIG. 4*a* is a top view of the pistol converter of FIG. 1.
Figure 4B:
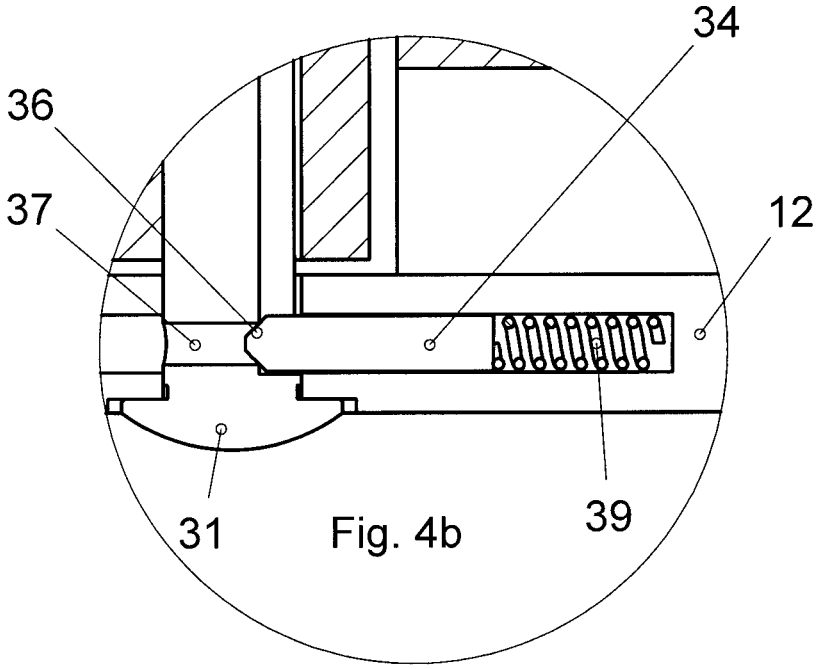
FIG. 4*b* is an enlarged detail view of the locking pin.
Figure 4C:
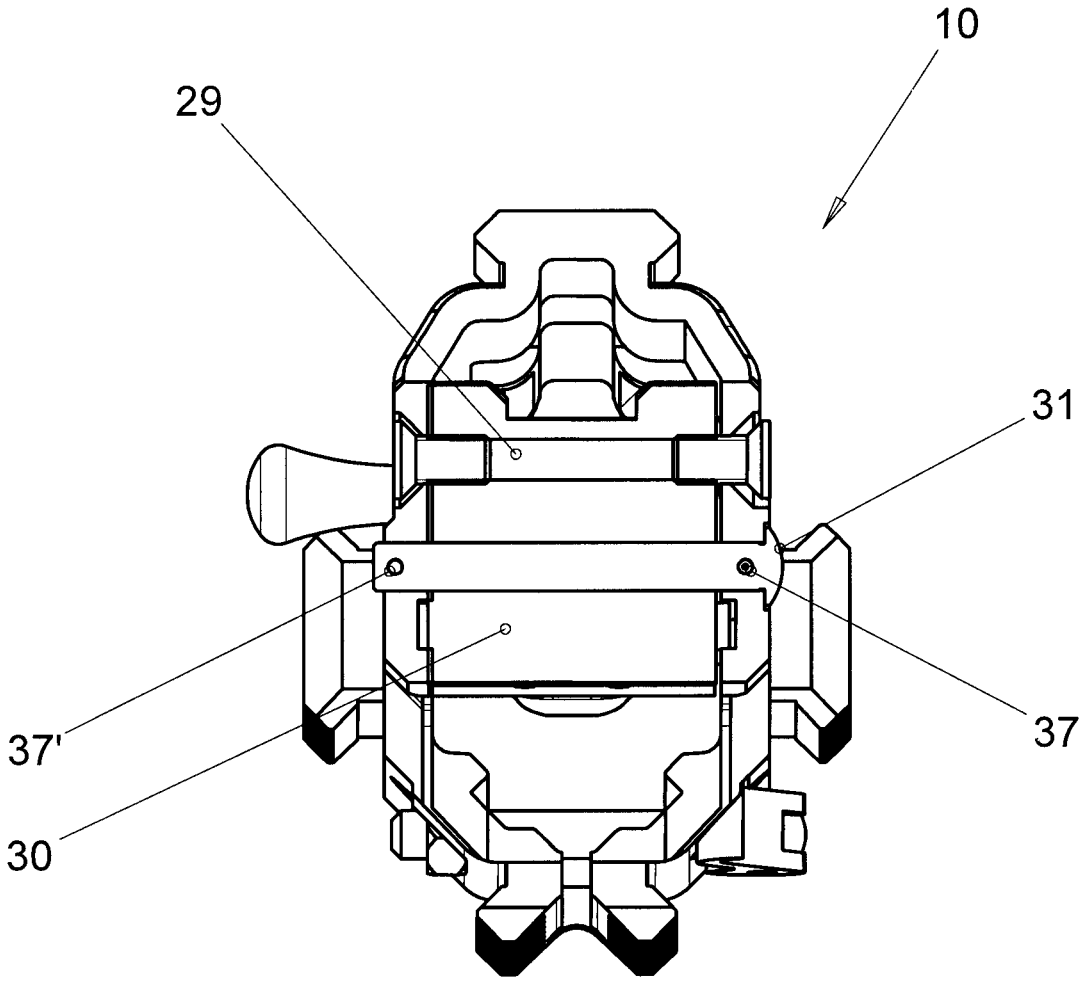
FIG. 4*c* is a sectional view of the pistol converter of FIG. 1 taken through line A-A.

In order to prevent the inadvertent release of locking pin 31, a further locking mechanism can be provided inside body 12 of converter 10. FIGS. 4*a* and 4*b* are partially cut away top and enlarged detail views, respectively, of a converter 10 having a locking pin 31 according to one embodiment of the invention. Locking pin 31 is secured with a spring biased rod 34 having a tapered end 36. As shown in enlarged view in FIG. 4*b*, locking pin 31 includes a depression or locking bore 37 for receiving rod 34. When locking pin 31 is fully inserted through body 12 and closure plate 30, rod 34 is urged by spring 39 into bore 37, thus securing locking pin 31 in place. In this way, closure plate 30 is fastened and rear engagement member 22 is held in place. Closure plate 30 fastened by locking pin 31 can be most clearly seen in FIG. 4*c*, which shows a sectional view through line A-A of FIG. 1.

When locking pin 31 is pulled out of body 12, the edge of bore 37 urges tapered end 36 of rod 34 out of bore 37, against the force of spring 39. Locking pin 31 preferably includes a second bore or depression 37' at its farther end, which can be engaged by rod 36 when the pin is almost out of the converter, so as to prevent pin 31 from falling completely out of the converter, while still permitting pivotal motion of closure plate 30. Thus, locking pin 31 can be removed from closure plate 30 and from the path of rear engagement member 22, allowing closure plate 30 to pivot about hinge 29 and removal or insertion of rear engagement member 22.

According to another embodiment of the invention, instead of, or in addition to rear engagement member 22, barrel engaging portion 13 may include a spring biased element, which urges the pistol rearwardly towards rear engagement member 22.

Figure 5:
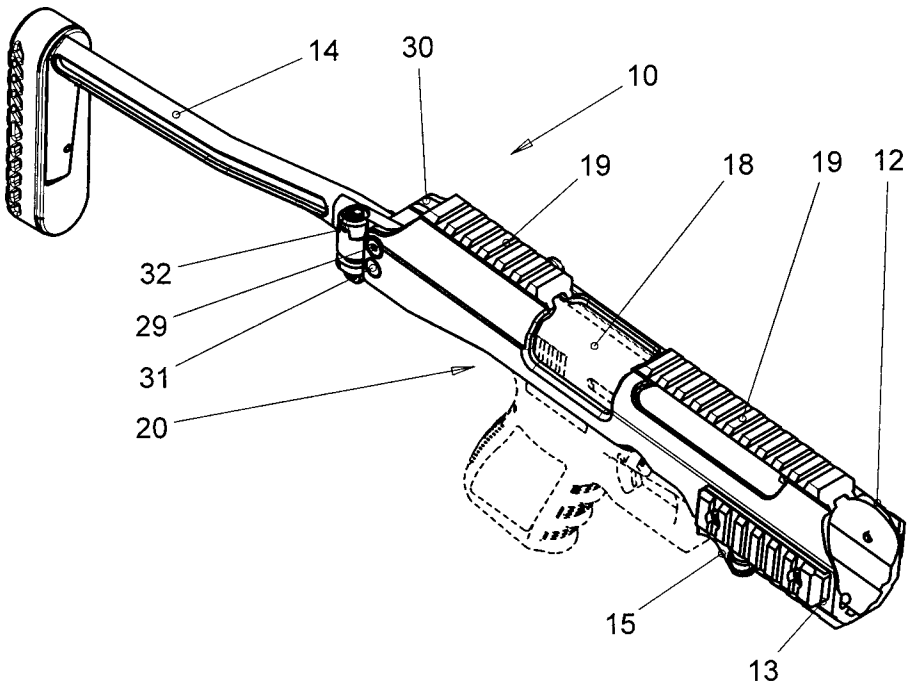
FIG. 5 is a perspective view of a pistol converter in accordance with one embodiment of the present invention, holding a pistol.
Figure 6:
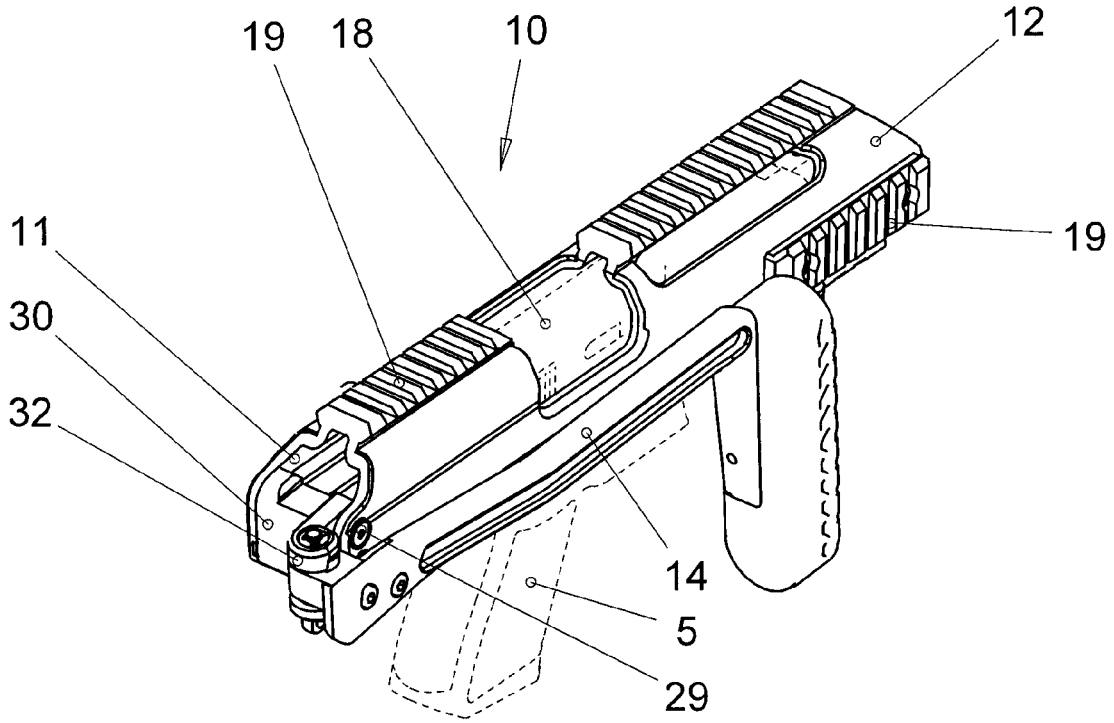
FIG. 6 is a perspective view of the pistol converter of FIG. 5, in a folded orientation.

Preferably stock 14 is a folding stock, permitting reduction of the length of the converter during carrying and/or use. FIGS. 5 and 6 show perspective views of pistol converter 10 holding a pistol, in respective unfolded and folded orientations. Stock 14 is preferably pivotally mounted on body 12 by means of a stock hinge 32. Stock hinge 32 permits the stock to be folded substantially adjacent to body 12, thereby substantially reducing the length of the converter for ease of transport. It will be appreciated that the pistol can be fired when the stock is in the folded orientation, as seen in FIG. 6.

Figure 7:
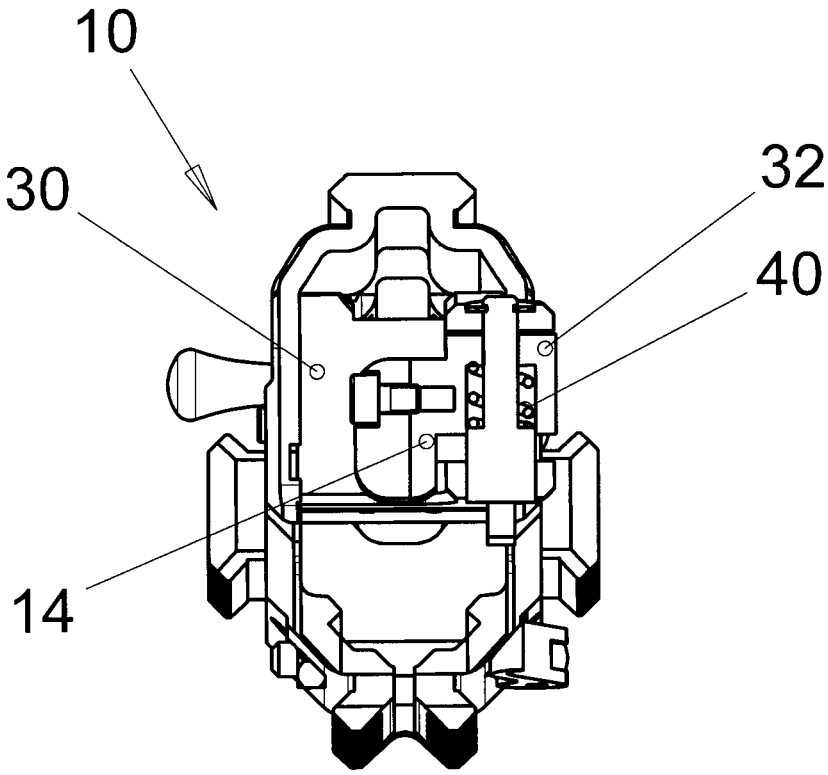
FIG. 7 is a sectional view of the pistol converter of FIG. 1 taken through line B-B.

FIG. 7 is a sectional view of converter 10 taken through lines B-B of FIG. 1, according to one embodiment of the invention. In this embodiment, stock hinge 32 is coupled to closure plate 30. A return spring 40 is provided in stock hinge 32 to urge stock 14 into either the folded orientation, or the unfolded orientation.

Figure 8A:
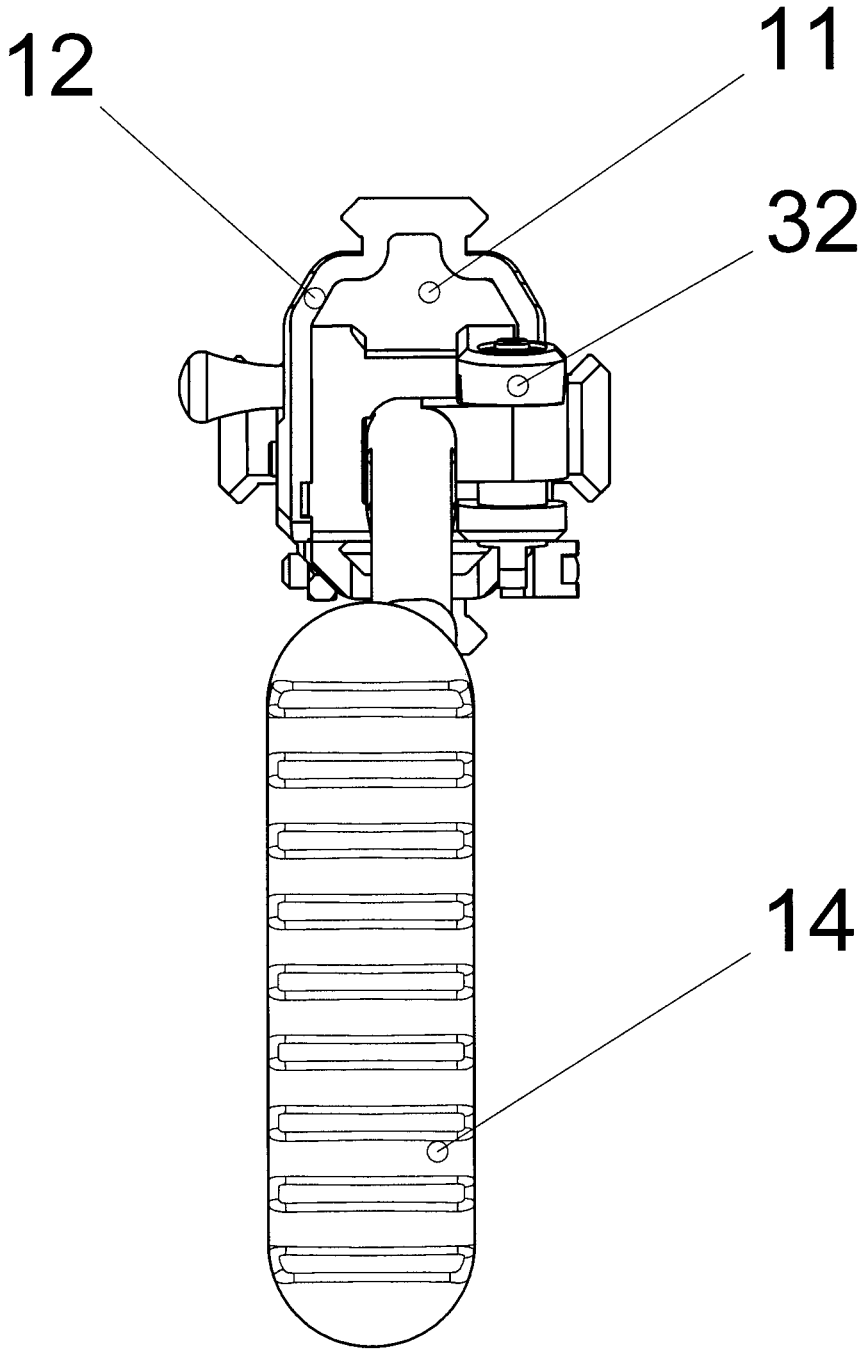
FIG. 8*a* is a back view of the pistol converter of FIG. 1.
Figure 8B:
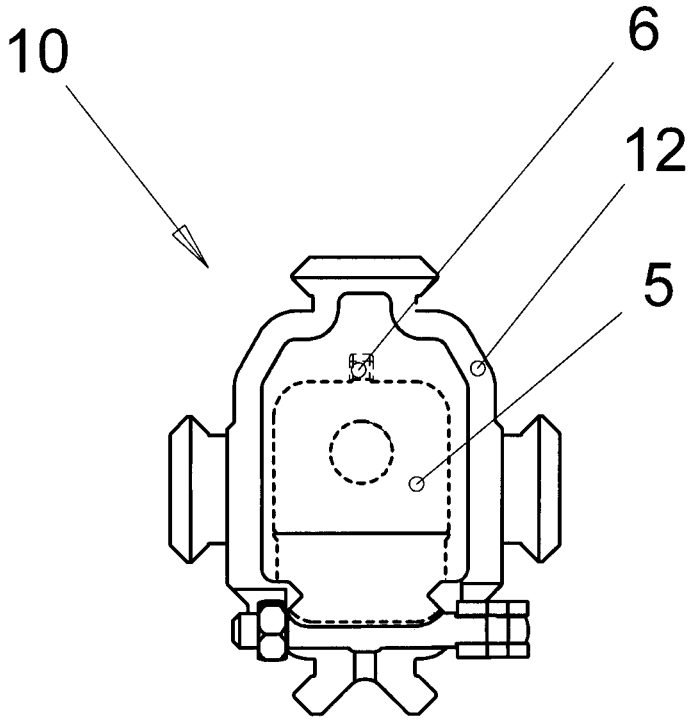
FIG. 8*b* is a sectional view of the pistol converter of FIG. 1*a* taken through line C-C.

It is a particular feature of the design of the converter of the present invention that the rear and front sights of the pistol, itself, can be used when aiming the pistol while it is held in the converter. FIG. 8*a* is a rear view of converter 10 without a pistol, and FIG. 8*b* is a front sectional view, taken through lines C-C of FIG. 1, of converter 10 holding a pistol 5. The rear portion 11 of converter body 12 is cut away so that it is open. In addition, the top of converter 10 and of the barrel engaging portion 13 are designed to allow pistols of different sizes and shapes to be mounted therein, and to provide a clear line of sight above the pistol through the converter body 12. As best seen in FIG. 8*b*, when a pistol 5 is mounted in converter 10, sights 6 of pistol 5 are can be seen through the opening in the rear 11 of the converter. Thus, a shooter can aim using the metal sights of the pistol, itself, through the opening in rear portion 11 and the open space defined between the top of pistol 5 and the top of body 12, rather than requiring an external sight mounted on mounting rails 19. Alternatively, or in addition, accessory sights may be mounted on mounting rail 19, on the converter, such as a Picatinny rail. In addition, as stated above, the converter has an aperture over the cartridge ejection port of the pistol, so there is no interference with the sight of the shooter.

It will be appreciated that the pistol converter has an ambidextrous design which permits utilization by both right- and left-handed shooters. If desired, the top and side mounting rails permit a user to mount accessories on the converter. Preferably, the stock is provided with a rubber butt plate (not shown) for extra comfort.

It will further be appreciated that pistols having longer barrels and/or silencers can also be accommodated by the converter of the present invention. Alternatively, a flash hider can be removably mounted in the barrel engaging portion 13, and can be replaced by a conventional silencer mounted on the converter body 12.

While the invention has been described with respect to a limited number of embodiments, it will be appreciated that many variations, modifications and other applications of the invention may be made.

The invention claimed is:

1. A pistol converter for a pistol including a barrel, a frame and a hand protecting protrusion on a rear of the frame, the protrusion protecting a hand from a slide of the pistol, the converter comprising:

a body having a pistol-engaging assembly for holding a pistol; and a stock coupled to said body;

said pistol-engaging assembly including:

a pistol barrel engaging portion in the front of the body; and a rear engagement member in said body, said rear engagement member including a spring loaded element defining a groove, said groove firmly and releasably engaging the hand protecting protrusion on the rear of the frame of the pistol mounted in said body;

said spring loaded element configured to urge the rear engagement member and a pistol mounted in the body forwards towards the pistol barrel engaging portion to firmly grip the pistol and prevent movement thereof in the converter.

2. The pistol converter of claim 1, wherein said barrel engaging portion includes a spring biased element, which urges the pistol rearwardly towards rear engagement member for firm engagement of a pistol in the converter.

3. The pistol converter of claim 1, wherein said body includes a cut-away rear opening through which sights on the pistol can be used.

4. The pistol converter of claim 1, wherein said stock is mounted on a hinge for folding adjacent the body.

5. The pistol converter according to claim 1, wherein said body includes a pair of mounting grooves, and said rear engagement member further includes complementary rails slidingly mounted in said mounting grooves.

6. The pistol converter according to claim 1, wherein said stock includes a closure plate for supporting said rear engagement member, and a hinge for pivoting said closure plate away from said body.

7. The pistol converter according to claim 1, wherein said rear engagement member is removably mounted in said body.

8. The pistol converter of claim 1, wherein said converter body includes at least one mounting rail for removably mounting an accessory on said body.

9. The pistol converter of claim 1, wherein said stock is a hinged, folding stock.

10. A method for forming a pistol converter for holding a pistol having a barrel, a frame and a hand protecting protrusion on a rear of the frame, the protrusion protecting a hand from a slide of the pistol, the method comprising:

forming a body defining a pistol barrel engaging portion in the front of the body;

mounting, in the body, a rear engagement member including a spring loaded element urging the rear engagement member and a pistol mounted in the body forwards towards the pistol barrel engaging portion, thereby firmly gripping the pistol and preventing movement thereof in the converter;

defining a groove in said spring loaded element for firmly and releasably engaging the hand protecting protrusion on the rear of the frame of the pistol mounted in the body; and coupling a stock to said body.

11. The method according to claim 10, wherein the step of coupling includes coupling by means of a hinge permitting folding adjacent the body.

12. The method according to claim 10, wherein the step of forming includes forming a body defining a spring loaded barrel engaging portion.

13. The method according to claim 10, wherein the step of forming includes forming a body defining at least one mounting rail for removably mounting an accessory on said body.

* * * * *